US005876035A

United States Patent [19]

Medina, Jr.

[11] Patent Number: 5,876,035

[45] Date of Patent: Mar. 2, 1999

[54] TAXI CAB MANAGEMENT BOARD GAME APPARATUS AND METHOD OF PLAY

[76] Inventor: Victor M. Medina, Jr., Suite 50, 593 Blackwood-Clementon Rd., Lindenwold, N.J. 08021-5901

[21] Appl. No.: 927,988

[22] Filed: Sep. 12, 1997

[51] Int. Cl.[6] ..... A63F 3/00

[52] U.S. Cl. ..... 273/254; 273/256; 273/290

[58] Field of Search ..... 273/254, 256, 273/251, 252, 249, 290

[56] References Cited

U.S. PATENT DOCUMENTS

| | | | |
|---|---|---|---|
| 1,544,515 | 6/1925 | Branning | 273/252 |
| 3,990,707 | 11/1976 | Terilli | 273/256 |
| 4,426,084 | 1/1984 | Michel | 273/254 |
| 4,809,987 | 3/1989 | Dvorak et al. | 273/254 |
| 4,887,818 | 12/1989 | Escott | 273/254 |
| 5,094,460 | 3/1992 | Morse et al. | 273/254 |
| 5,322,294 | 6/1994 | Landfield | 273/254 |

FOREIGN PATENT DOCUMENTS

| | | | |
|---|---|---|---|
| 645661 | 11/1950 | United Kingdom | 273/252 |
| 709543 | 5/1954 | United Kingdom | 273/252 |
| 784604 | 10/1957 | United Kingdom | 273/254 |

*Primary Examiner*—Benjamin H. Layno
*Attorney, Agent, or Firm*—Dann, Dorfman, Herrell and Skillman, P.C.

[57] ABSTRACT

A taxi cab management board game providing a gaming environment and associated apparatus wherein the players experience the daily routine and practical business pressures associated with the successful operation of a taxi cab business. The game playing surface is comprised of interconnected location blocks 12 denoting geographical locations for navigation of vehicle playing pieces 20 to transport fare playing pieces 25. Fare playing pieces may be selected based on their physical proximity to vehicle playing pieces or assigned by an instruction card set 34A. Vehicle playing pieces 20 transport fare playing pieces 25 to assigned destinations accumulating transportation revenue and possible gratuity income. The player is limited economically by traffic, government regulation and practical business choices in the quest to expand the taxi company through the purchase of three company expansion certificates 50. The game is completed when a player purchases three expansion certificates or all opponents are disqualified by driving habits or poor money management skills.

6 Claims, 13 Drawing Sheets

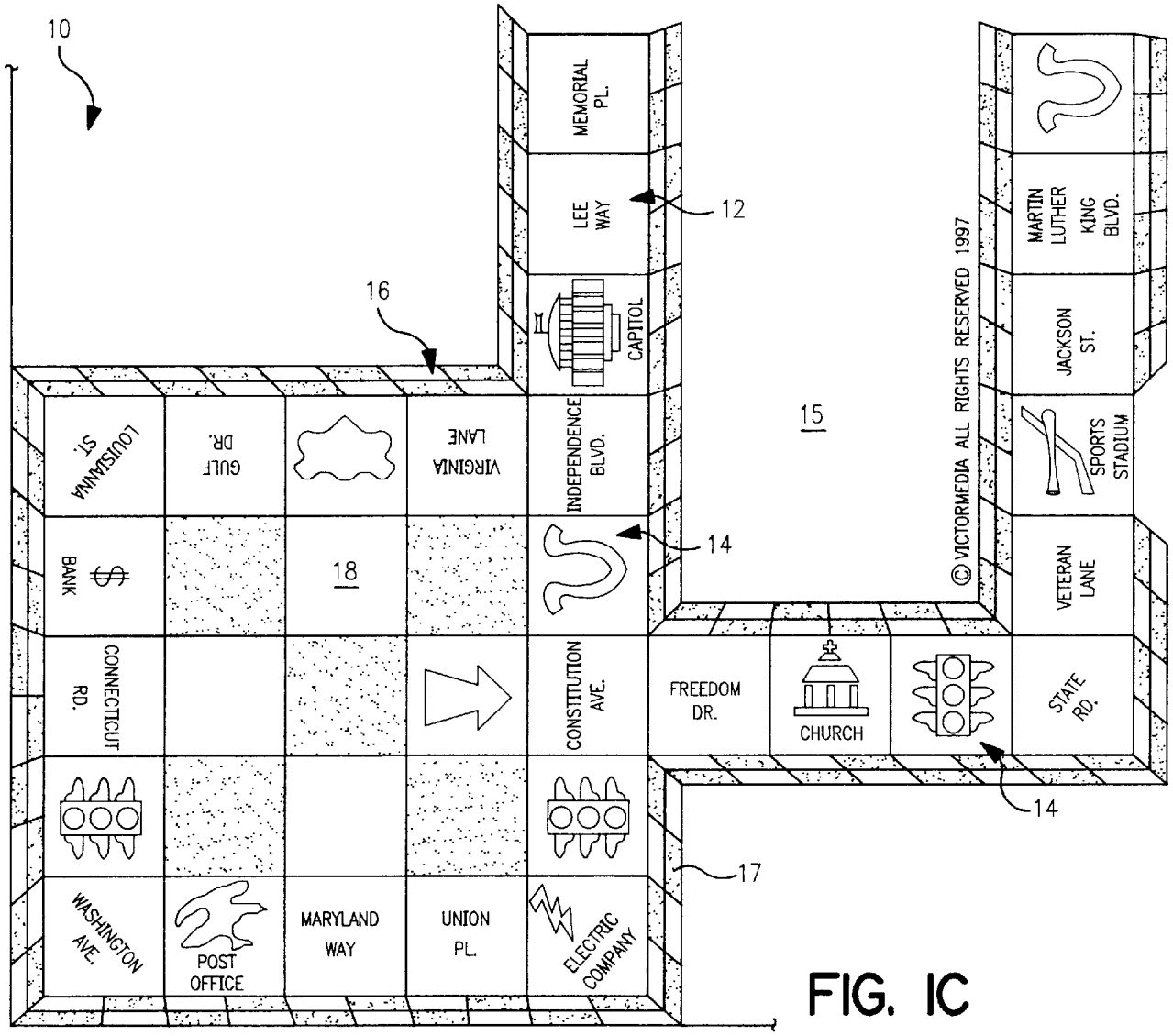
FIG. IC

TAXI CAB MANAGEMENT BOARD GAME APPARATUS AND METHOD OF PLAY

FIELD OF THE INVENTION

This invention relates to board games. More specifically, this invention provides a gaming environment and associated apparatus wherein the players experience the daily routine and practical business pressures associated with the successful operation of a taxi cab business.

BACKGROUND OF THE INVENTION

The taxi cab provides a mode of transportation unique in experience among the various methods of mass transit. Unlike traditional bus and train service, the utilization of taxi cab services demands a personal interaction between passengers and taxi operators. As such, it is not enough for taxi operators to simply provide a reliable alternative source of transportation, but the successful taxi operator must additionally provide some degree of personalized customer service.

The successful taxi operator is capable of balancing an aggressiveness in transporting and obtaining customers while simultaneously maintaining a courteous and often personable demeanor. Indeed, passengers unfamiliar with a certain locality often rely on taxi operators to recommend area restaurants, hotels and attractions. Thus, the truly helpful and courteous operator is increasingly likely to earn gratuity income in excess of his/her colleagues who are less customer service oriented.

The game in accordance with the present invention seeks to simulate the above described environment by providing a board game in which players are rewarded not only for their business acumen, but for their customer service skills as well.

SUMMARY OF THE INVENTION

The present invention provides a taxi cab management game for use with at least two players as a contest of economic strategy and customer service skills. A game board and associated playing pieces are provided for simulating the taxi cab business environment.

Specifically a game matrix is provided wherein interconnected location blocks labeled with destination names and symbols form a playing surface. Vehicle playing pieces are associated with each game participant for navigating the location blocks in search of passengers or "fare" playing pieces. Additionally, destination markers or "cone pieces" are provided to keep track of fare playing piece destinations.

The vehicle playing pieces are designed to couple with the fare playing pieces such that the fare is physically transported from a pick-up location to a drop-off location block.

The vehicle playing pieces are advanced on the playing surface by utilizing a first chance number indicator such as a die or spinning wheel. A second chance indicator is supplied wherein the various player vehicle colors are represented along with two alternative routes. The second indicator enables vehicles to forego the use of the first random chance indicator in some instances. Additionally, a third chance indicator is supplied wherein the fare value, traffic fine, fare tip, and traffic points may be determined simultaneously.

Player fares are randomly located on the playing surface according to the instructions of a location card set. Upon pick-up of the fare, a second location is determined from the card deck defining the fare destination. Additionally, random location blocks have symbols indicators referencing an associated instruction card set which provide reductions in income and/or a change in vehicle direction.

The path to each new fare or drop-off point is determined by player strategy, each player designing to traverse the minimum number of blocks each trip. Player's utilize the alternative routes "short-cut" or "cut-off" indicia of the second random chance indicator to abbreviate pick-up or drop-off trips when possible to maximize fare income over time.

BRIEF DESCRIPTION OF THE DRAWINGS

The foregoing summary, and the following detailed description, will be best understood when read in conjunction with the attached drawings, in which:

FIGS. 1A to 1D are plans of which respective guadrants of a game board (layout) for the game in accordance with the present invention;

DETAILED DESCRIPTION OF THE PREFERRED EMBODIMENT

Figure 1A:
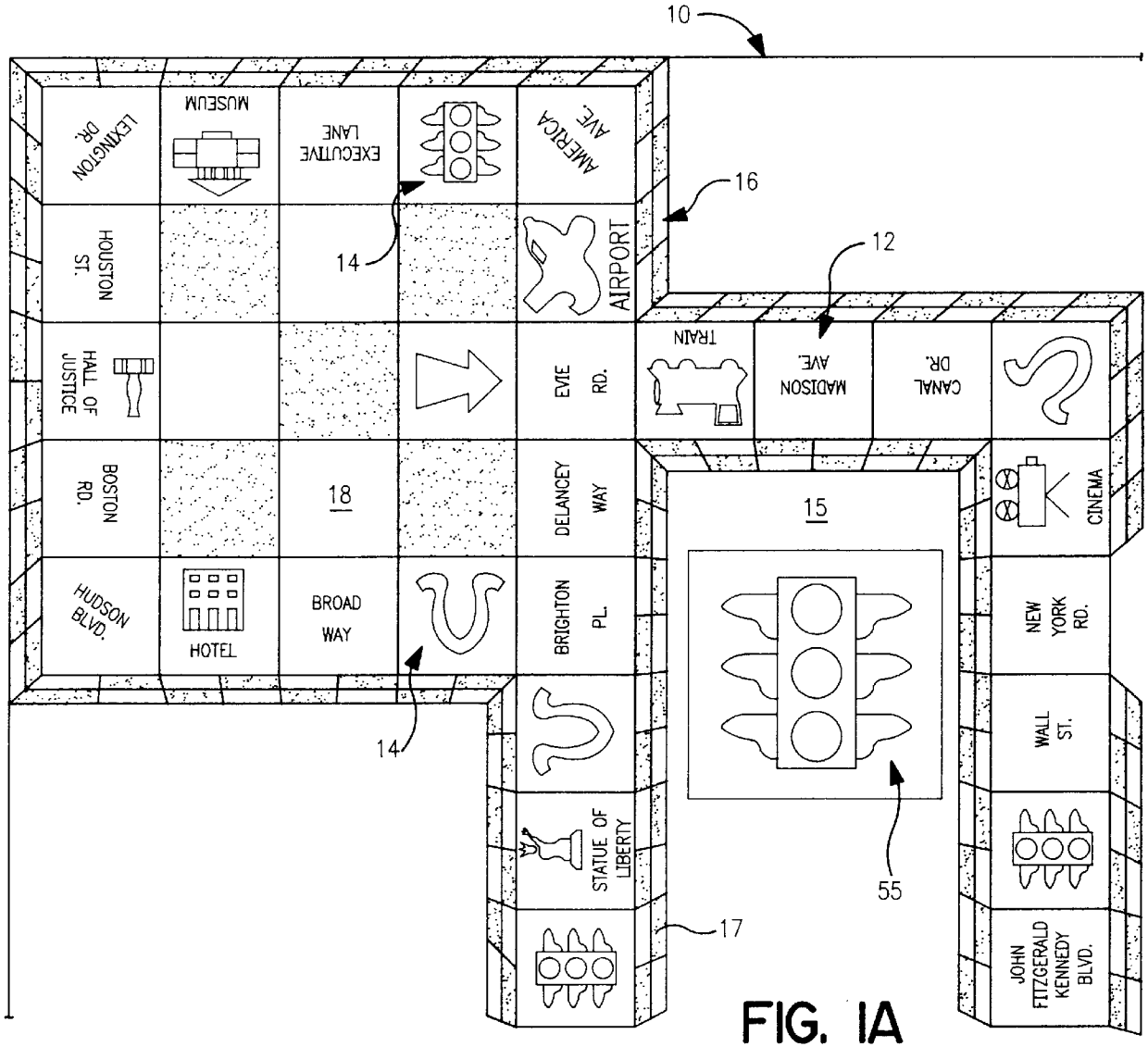
Figure 1B:
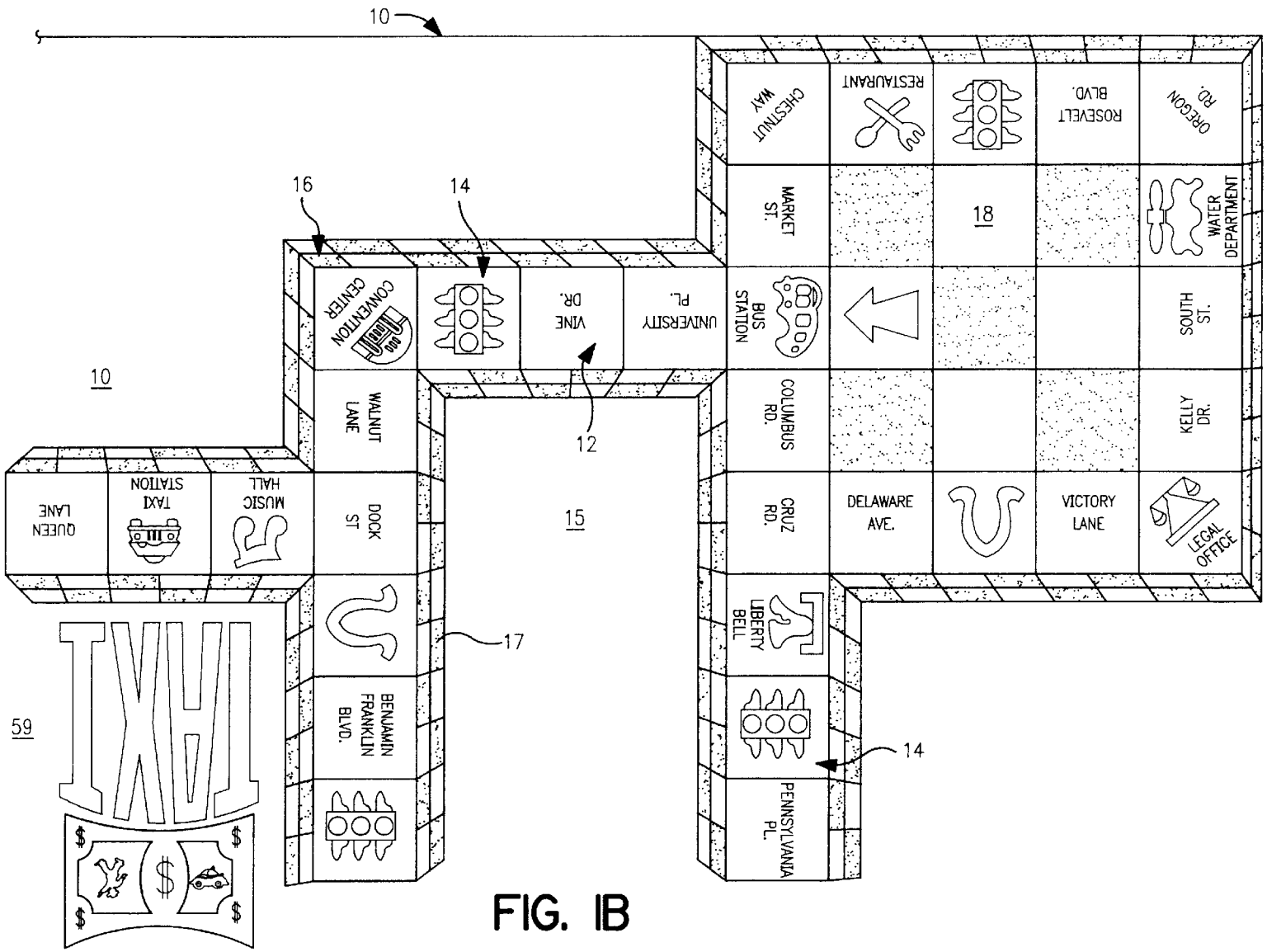
Figure 1D:
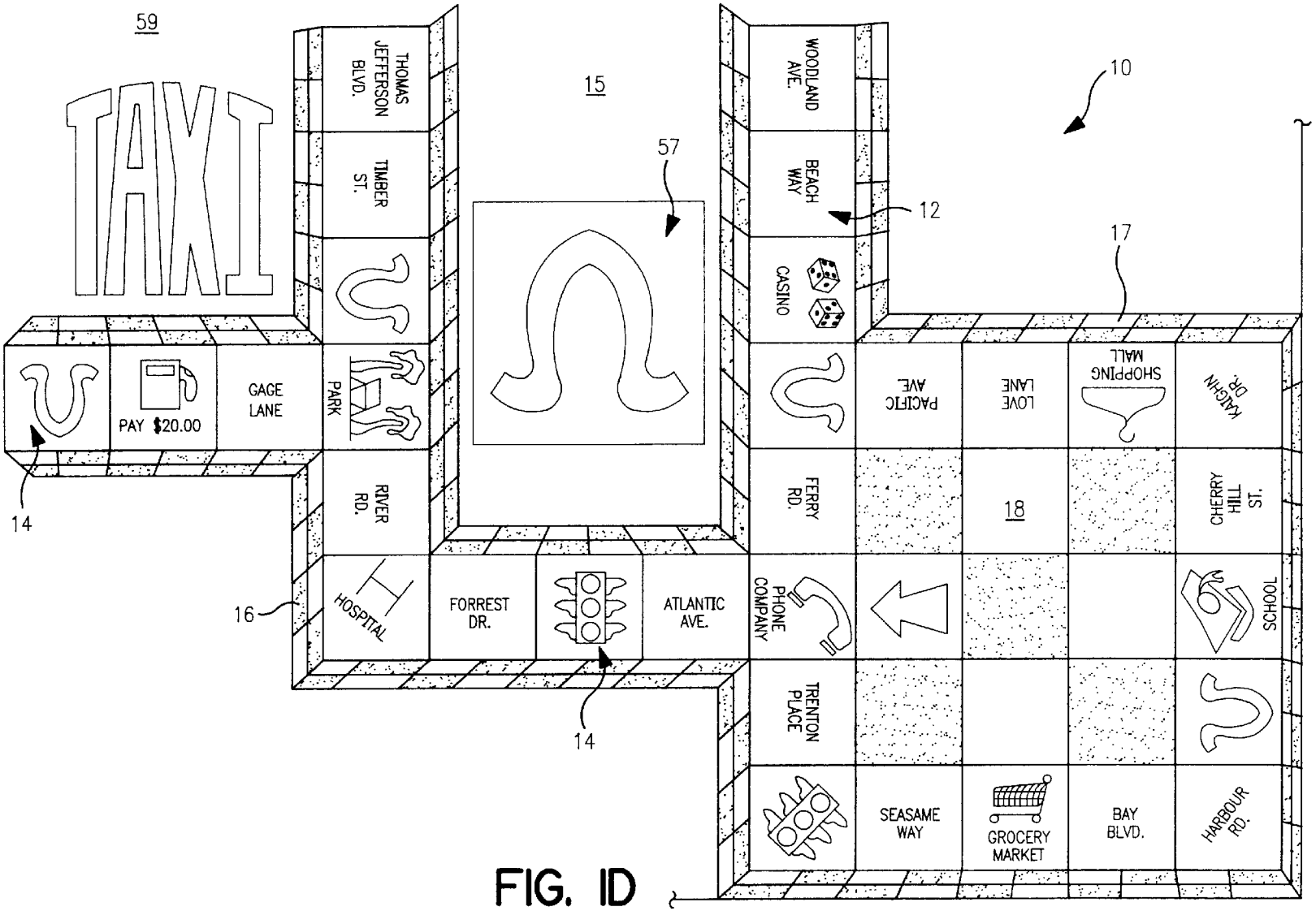

A taxi cab management game in accordance with the present invention engages at least two players in a contest of economic strategy and customer service skills while simulating the successes and perils associated with operating a taxi cab business. The player to first expand his/her operations by acquiring three company expansion certificates is deemed the winner of the game. Alternatively, players may be eliminated from the game because of extensive economic hardship, or adverse consequences resulting from burdensome governmental regulations and/or traffic violations. In this alternative, the winning player is the only company that remains financially viable.

The taxi cab management board game is composed of a playing board, vehicle playing pieces, fare playing pieces, destination markers, card sets, game currency, company expansion certificates, and random chance indicators.

GAME APPARATUS

Referring now to FIGS. 1A, 1B, 1C, and 1D a playing board 10 for the taxi cab management game is shown. In the embodiment shown, the various components of the playing board 10 are utilized by at least two game participants in accordance with a predefined rule set described herein.

The playing board 10 is formed of a cardboard-type material preferably foldable along a central axis. The playing surface 15 of playing board 10 has interconnected location blocks 12 formed or imprinted thereon. The location blocks 12 are individually designed to contain graphical representations and/or textual descriptions of typical commuter pick-up points, "origins," and drop-off points, "destinations." The location blocks 12 are of uniform size and shape with respect to each other, the particular geometric configuration is dependent on the design choices of those reasonably skilled in the art, in the preferred embodiment the blocks are square. For example, interconnected location blocks 12 can be comprised of a set of tourist attractions and/or well known areas common to a specific geographical locality or commuting region. Reference blocks 14 are included among the interconnecting location blocks 12. Reference blocks 14 contain indicia that correspond to one of three card sets which contain written instructions for game players as described more fully hereinbelow.

Playing surface 15 also has dispatch areas 18 which serve as starting points for each player. The dispatch areas 18 are preferably colored to correspond to the colors of the vehicle playing pieces.

Card set areas 55, 57, and 59 are included on playing surface 15 for the placement of card sets containing both graphical and textual information. Card set areas 55 and 57 are identified by a large traffic light and a horse shoe symbol, respectively. Area 59 is located at the center portion of playing surface 15 and is labeled with the designation "taxi."

A colored zone border 16 defines the outermost perimeter of the playing surface 15. The border 16 is colored differently at various, preferably four, zones on the playing surface 15. The colored zone border is composed of uniquely colored contiguous segments 17. The number of uniquely colored segments 17 corresponds to the number of desired location block groups. The colored border 16 facilitates the locating of specific destination blocks 12, which are color coordinated with zone border 16.

In an alternative embodiment, the function of colored border 16 may be performed by the uniform coloring of groups of interconnected location blocks 12. The locations of the block groupings may additionally conform to compass headings which correspond to different areas of the playing surface 15. For example, areas of the board 10 may be designated North, South, East or West with the appropriate initial (i.e. N, S, E, W) marking each uniformly colored, grouped interconnected location block 12.

The dispatch areas 18 for each player are preferably located within a zone of the playing surface 15 having a segment 17 of colored zone border 16 that matches the color of a player's vehicle playing piece, in the alternative embodiment dispatch areas 18 are colored to match surrounding colored, groups of interconnected location blocks 12, which preferably match the color of a player's vehicle playing piece. However, embodiments utilizing playing pieces which are metallic or essentially identical in color can also be used. In this embodiment the colored zone border 16 or colored groups of interconnected location blocks 12 are still utilized to facilitate the location of specific destination blocks.

Figure 9:
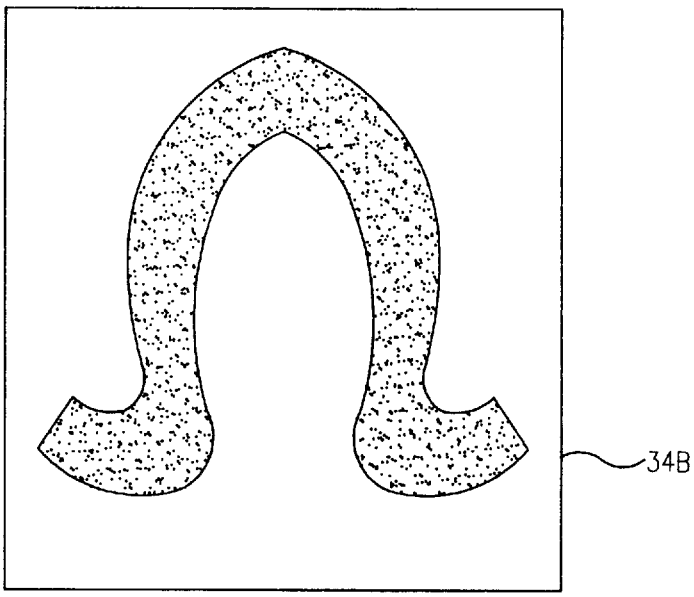
FIG. 9 is a view of the primary surface of a "luck" playing card.
Figure 10:
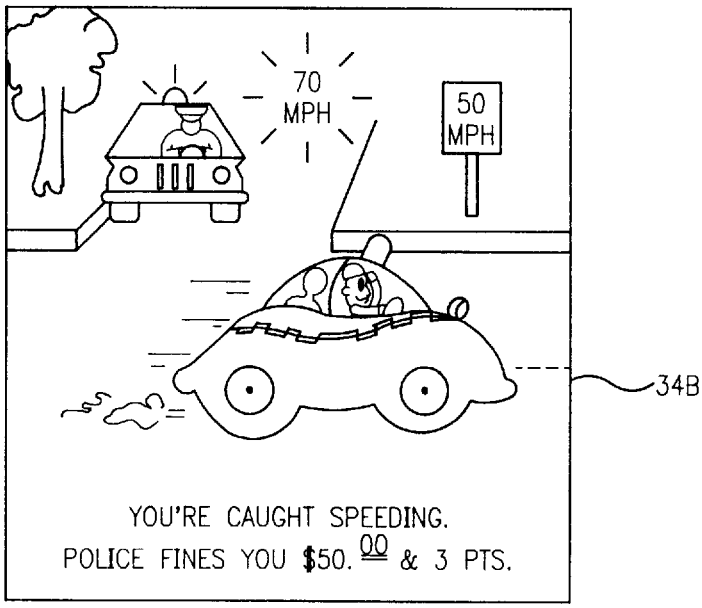
FIG. 10 is a view of secondary surface of the "luck" playing card shown in FIG. 9.
Figure 11:
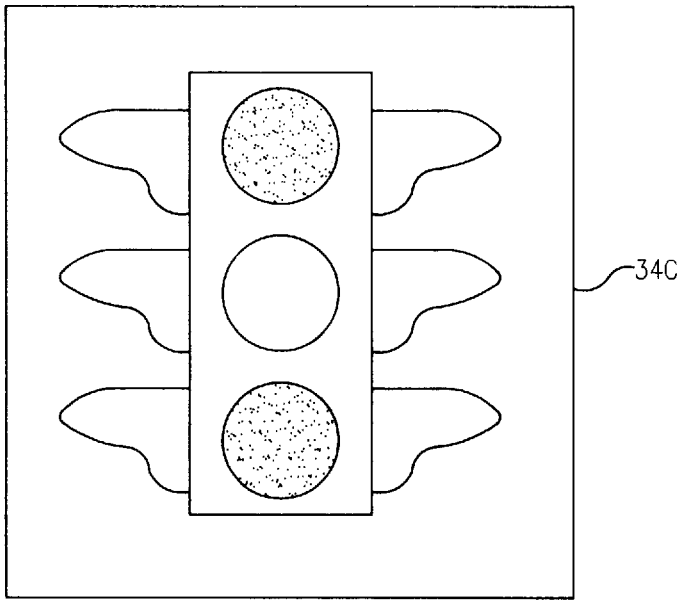
FIG. 11 is a view of a primary surface of a "traffic" playing card.
Figure 12:
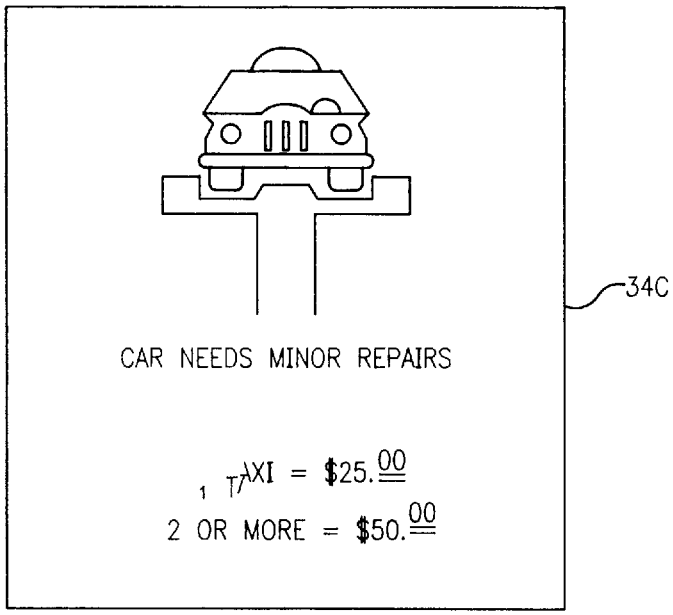
FIG. 12 is a view of a secondary surface of a "traffic" playing card.
Figure 13:
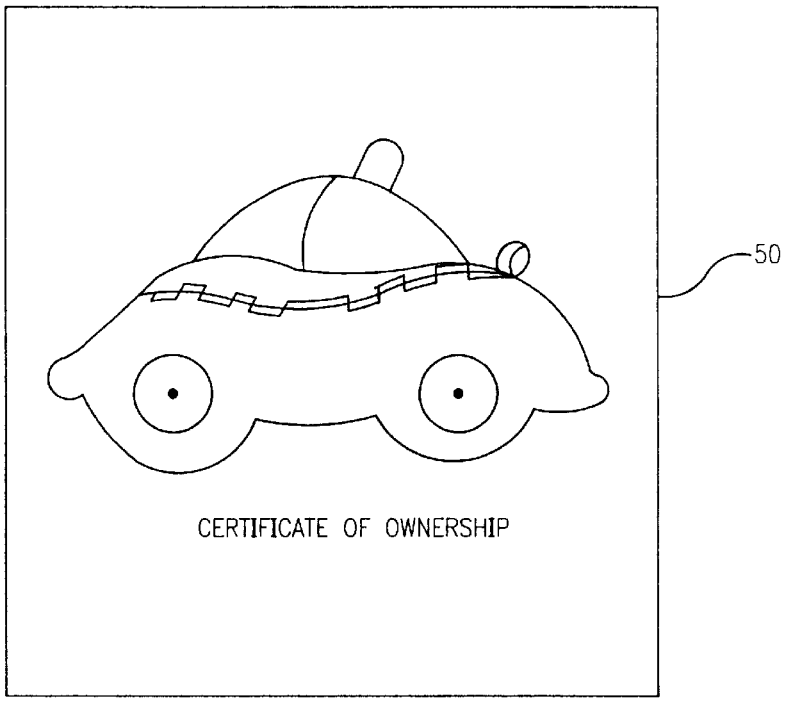
FIG. 13 is a front view of a primary surface of a company expansion certificate.

The reference blocks 14 located on the playing surface 15 are identified with each of two distinct playing card sets namely, a traffic card set and a luck card set. A typical traffic card 34 is shown in FIGS. 11 and 12 and a typical luck card is shown in FIGS. 9 and 10. The card sets are stacked one on top of the other having their secondary surfaces facing the playing surface 15. The traffic card set and luck card set are preferably placed in card set areas 55 and 57, respectively. Vehicle playing pieces 20 which occupy reference blocks 14 corresponding to either card set 34B or 34C during game play, must adhere to the instructions illustrated by the primary surface of card sets 34B and 34C. For example, the traffic card set 34B and luck card set 34C are imprinted with text and symbols that describe events and occurrences with which a player must deal during game play. The events and occurrences in traffic card set 34B reduce income by fining players for traffic violations and regulatory expenses. Traffic card set 34B may be utilized in conjunction with a spinning chance indicator 42 in order to determine the appropriate number of penalty points for each traffic violation. Lastly, luck card set 34C reduces (i.e. "bad luck") or increases player income (i.e. "good luck") through unexpected business revenue or expenses.

In an alternative embodiment, Traffic card set 34B does not include cards assigning points against a player's license and requiring use of spinning chance indicator 42. Instead these cards are included in fare direction card set 34A.

Figure 16:
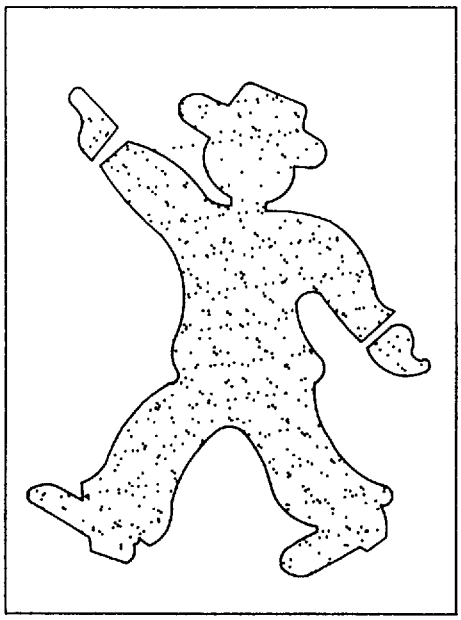
FIG. 16 is a view of a primary surface of a fare direction card.
Figure 17:
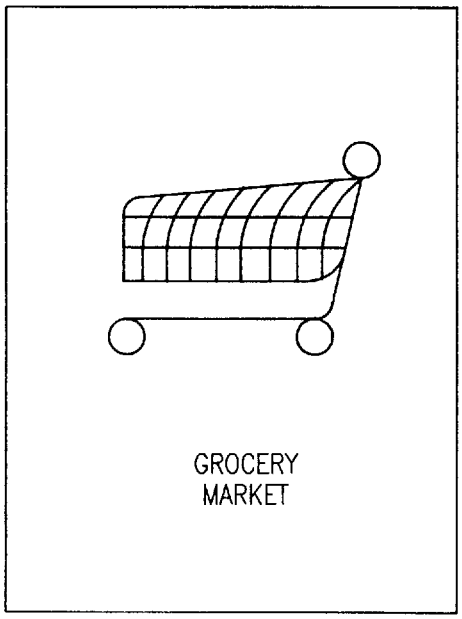
FIG. 17 is a view of a secondary surface of the fare direction card shown in FIG. 16.

Referring now to FIGS. 16 and 17, the fare cards, designated as card set 34A, indicate on their primary surface the specific location block 12, color, area of the board (i.e. N, S, E, W). The selected card represents the pick-up location of a fare playing piece. In the embodiment shown in FIG. 1, card set area 59 contains indicia such as the word "taxi", identifying it as an area for fare cards.

Figure 2A:
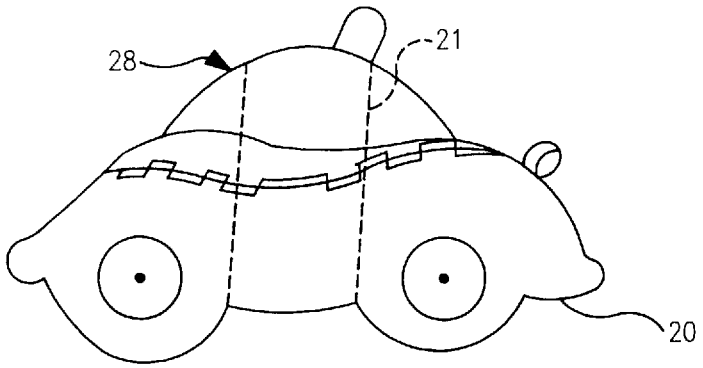
FIGS. 2A and 2B are, respectively, a side elevation view and a top plan view of a vehicle playing piece.
Figure 2B:
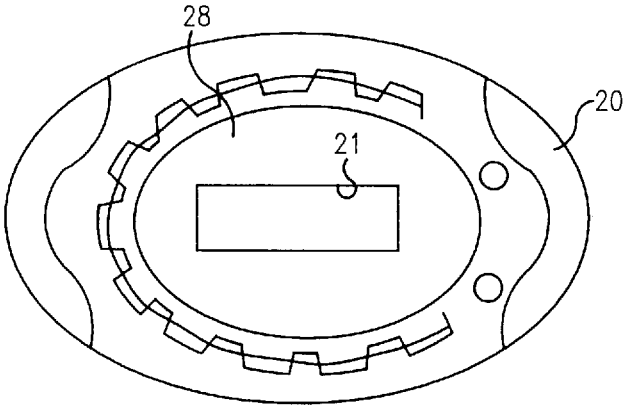

Referring now to FIGS. 2A and 2B, the vehicle playing pieces 20 are preferably formed of plastic or metal to resemble miniaturized taxi cabs. The vehicle playing piece 20 has a receptacle 21 formed through its roof portion 28 for receiving a fare playing piece.

Figure 3:
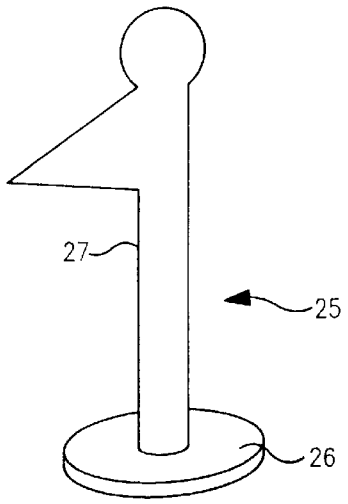
FIG. 3 is a top side perspective view of a fare playing piece.

As shown in FIG. 3, the fare playing piece 25 has a base portion 26, and flag portion 27. The fare playing piece 25 is designed to couple to the vehicle playing piece 20 such that the two pieces are readily moved around the board as a single composite playing piece when game circumstances require, simulating the pick-up and transport of a fare. Fare playing piece 25 is dimensioned such that it will extend above the vehicle playing piece 20 when placed in receptacle 21.

Figure 4A:
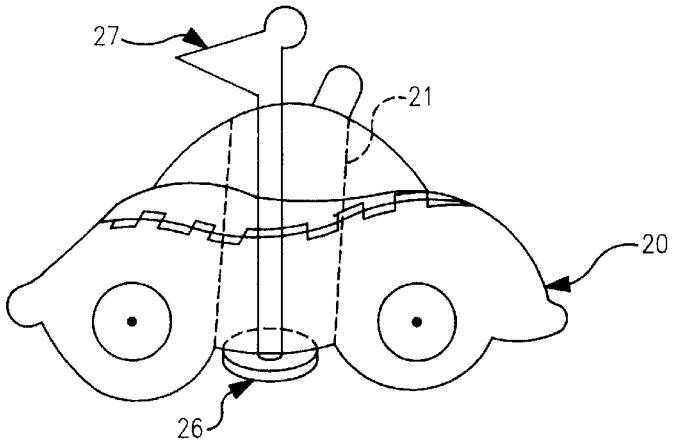
FIGS. 4A and 4B are, respectively, a side elevation view and a top plan view of a vehicle playing piece coupled with a fare playing piece.
Figure 4B:
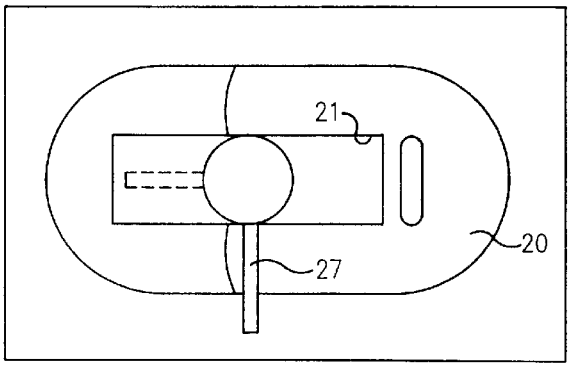

In the preferred embodiment, fare playing piece 25 is coupled to the vehicle playing piece 20 through the receptacle 21, as shown in FIGS. 4A and 4B. Receptacle 21 has a lengthwise dimension slightly greater than flag portion 27 of fare piece 25. The coupling of the vehicle playing piece 20 and fare playing piece 25 is achieved by placing the vehicle playing piece 20 over top of the fare playing piece 25. The flag portion 27 of fare playing piece 25 is aligned, parallel with the receptacle 21 of vehicle playing piece 25 for insertion. Upon insertion, the fare playing piece 25 is rotated such that flag portion 27 is no longer parallel but transverse with respect to the lengthwise dimension of receptacle 21. The flag portion 27 of fare playing piece 25 is in this way positioned to rest on the roof portion 28 of vehicle playing piece 20. The fare playing piece 25 is removed from the vehicle playing piece by aligning the flag portion 27 with the receptacle 21 and lifting the vehicle playing piece 20 from the fare playing piece 25.

Figure 18:
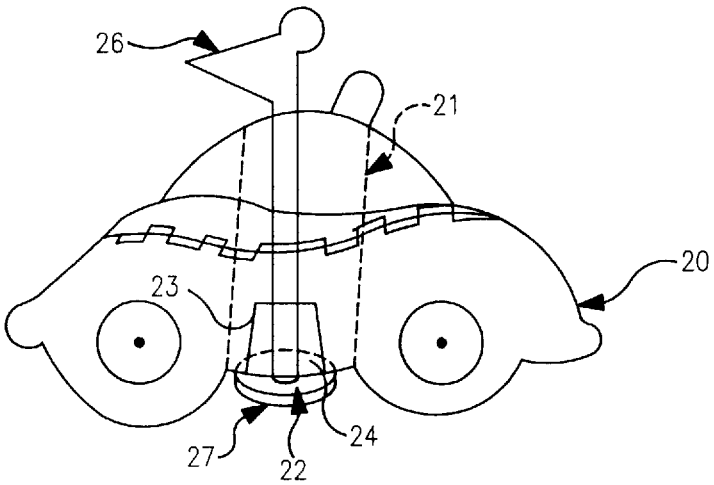
FIG. 18 is an alternative embodiment of a vehicle playing piece coupled to a fare playing piece.

In an alternative embodiment shown in FIG. 18, the receptacle 21 of vehicle playing piece 20' has a lowermost region 22 circumscribed with a metallic plate 23 designed to engage a permanent magnet 24 resting on the base portion 27 of fare piece 25. The fare playing piece 25 is removed by aligning the flag portion 26 with the vehicle receptacle 21 and disengaging the permanent magnet 24 from the metallic plate 23 by pushing the flag portion down through vehicle receptacle 21.

Figure 5:
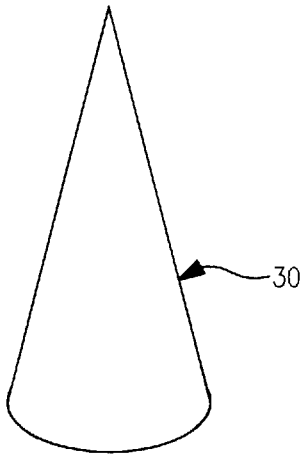
FIG. 5 is a top side perspective view of a conical marker playing piece.

Referring now to FIG. 5, once the fare playing piece 25 is coupled to the vehicle playing piece 20, players mark the fare drop-off block by placing a destination marker 30 on the appropriate inter-connected location block 12. The destination marker 30 is formed to resemble a miniaturized traffic cone.

Figure 6:
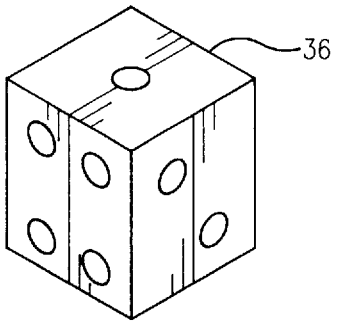
FIG. 6 is a perspective view of a first chance indicator.

As shown in FIG. 6, a first chance indicator 36 is provided to advance vehicle playing pieces 20 about the playing surface 15. The chance indicator 36 is preferably a six sided die having numerical representations on each of the six die faces 37. The numerical representation of die faces 37 preferably correspond to numbers one through six with each face consisting of a single numeral or graphical representation thereof. In the preferred embodiment a plurality of first chance indicators 36 are utilized depending on the desired pace of the game.

Figure 7:
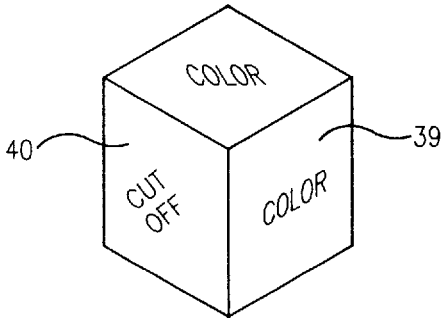
FIG. 7 is a perspective view of a second chance indicator.

Referring now to FIG. 7, a second random chance indicator 38 is composed of color indicia 39 and movement indicia 40. The chance indicator 39 is multi-sided die having at least two movement indicia 40 and separate color indicia corresponding to the color of each vehicle playing piece 20. In the preferred embodiment four colors are employed to identify the four vehicle playing pieces 20: red, green, yellow, and blue which are individually represented on four separate faces of the second random chance indicator 38. In embodiments utilizing vehicle playing pieces 20 of uniform color, color indicia 39 may alternatively include graphical representations, numbers or symbols to distinguish vehicle playing pieces 20.

The remaining two faces contain the movement indicia 40. In the preferred embodiment, the movement indicia 40 are imprinted on two opposing faces of the second random chance indicator 38. The preferred movement indicia are the terms "cut-off" and "short-cut." In an alternative embodiments additional color indicia 39 or movement indicia 40 may be incorporated into the second random chance indicator 38. For example, in embodiments with more than four players additional color indicia will be required, similarly additional movement indicia may be included such as "detour" forcing players to skip a turn.

Figure 8:
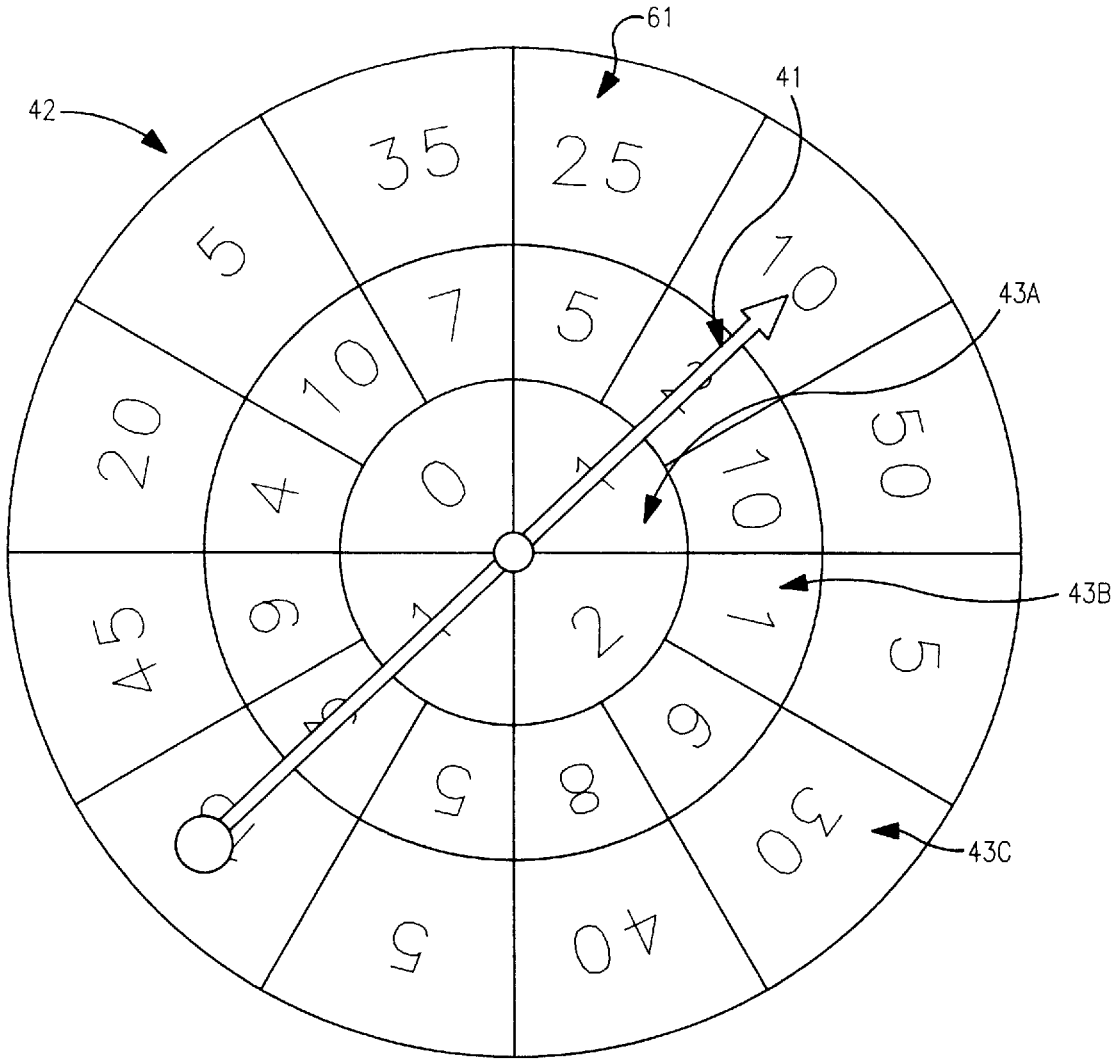
FIG. 8 is a plan view of a spinnable chance indicator.

Referring now to FIG. 8, a spinning chance indicator 42 has primary surface 61 and spinning needle 41. Primary surface 61 includes numerical scales 43A, 43B, and 43C. The spinning chance indicator is preferably a cardboard-type template having the spinning needle 41 rotatably coupled to its primary surface. As indicated in FIG. 8, the surface of the spinning chance indicator 42 has a plurality of concentrically located numerical scales.

During a traffic violation spin, the innermost scale 43A and middle scale 43B are used in conjunction with traffic card set 34B to determine the amount of traffic "points" judged against a game participant as determined by the innermost scale 43A and the monetary value of traffic fines by the outermost scale 43C. During a transportation service spin, the outermost scale 43C indicates the monetary value of the transportation service performed by retrieving a fare playing piece 25 and moving the piece to a location block 12 defined by destination marker 30. Additionally, the middle scale 43B indicates the amount of gratuity added to the monetary value of the transportation service.

METHOD OF PLAY

At the outset of the game, each player receives a single vehicle playing piece 20 a destination marker 30, as well as a company expansion certificate 50, preferably playing pieces 20, 30 and company expansion certificate 50 are of uniform color. The vehicle playing piece 20 is placed in the dispatch area 18 having a color corresponding to the color of vehicle playing piece 20, where no vehicle color or corresponding dispatch color exists the players are free to select any dispatch area 18.

A banker is designated to control and handle all monetary and administrative transactions that take place during the game. The banker may be a game player or a designated impartial third party. The banker dispenses to each player $100 in game currency 48, preferably one $50 dollar bill, one $20 dollar bill, one $10 dollar bill, two $5 dollar bills, and ten $1 dollar bills.

The order of play is determined by rolling the first chance indicator 36 and setting the order of play based on the numerical order of the results with the highest roller proceeding first. The first player, followed by the remaining players in order, selects a card from the fare card set 34A. The player places a fare playing piece 25 on the playing surface 15 at the appropriate location block defining a "pick-up" navigational point, as required by the card drawn from fare direction card set 34A. The fare cards 34A are stacked one on top of the other with the secondary surface facing opposite the playing surface 15. The fare playing pieces 25 identify or mark the destination for the player drawing the respective card. The player then determines an appropriate route and advances her vehicle playing piece 20 to the location block 12 of the appropriate fare playing piece 25.

The player determines the direction she will proceed to arrive at the fare playing piece 25, preferably traversing a minimum number of location blocks 12. The player determines the number of location blocks 12 she is permitted to advance each turn by utilizing one or more first random chance indicators 36 in conjunction with the second random chance indicator 38. In the preferred method of play a set of three first random chance indicators 36 is utilized.

If the second random chance indicator 38 matches the color of a player's vehicle playing piece 20, the player may disregard the indicia on the first random chance indicators and proceed directly to the block 12 containing the fare playing piece 25, non-matching colors have no effect on player movements.

In the event that a movement indicia 40 is indicated, the player may make the appropriate movement indicated on the second random chance indicator 38 if conditions merit such movement. For example, the movement indicia "Cut-off" enables the player to pick up the closest opponent fare playing piece 25 as long as the player's vehicle playing piece is not presently coupled to a fare playing piece. The movement indicia "short-cut" permits a player having a fare playing piece 25 already "loaded" to proceed directly to the fare destination.

Players arriving at the fare location block 12 load the fare playing piece 25 into the vehicle playing piece 20 and draw a card from fare card set 34A defining a "drop-off" location for the fare playing piece 25. The player marks the drop-off block by placing his destination marker 30 on the appropriate inter-connected location block 12. Next, the player advances in the direction of the destination marker 30 by utilizing the first and second random chance indicators. Upon reaching the block containing the destination marker 30, the player spins the spinning chance indicator 42 at least once to determine the monetary value of the fare as indicated by scale 43B. If the player satisfies additional customer service requirements she may be eligible to spin the chance indicator 42 to determine a customer service gratuity as indicated by scale 43C. In the preferred embodiment only those players giving the appropriate predefined oral response upon fare drop-off are entitled to a gratuity spin. For example, players agree upon a phrase which conveys a professional attitude and courteous demeanor, players then must recite the predefined phrase such as "Thank-you for utilizing XYZ cab services" upon a fare drop-off to qualify for a gratuity spin. The player then continues to play by selecting another card from the fare card set 34A to define the location of a new "fare" or fare playing piece 25. The player places a fare playing piece 25 on the playing surface 15 at the appropriate location block defining a new "pick-up" navigational point, as required by the card drawn from fare direction card set 34A.

The amount of the fare and any gratuity is paid to the player by the banker. The amount of the fare and possible gratuity spin are multiplied by the number of company expansion certificates 50 owned by a player. Company expansion certificates 50 which are serving as collateral for a bank loan are not considered when determining the above stated multiplication factor. For example, a player holding 2 certificates collects three times the income (2 certificates plus original) however, if one of these certificates was serving as bank collateral the player would only receive double the income until the loan on the certificate was repaid to the bank. In the preferred embodiment each company expansion certificate 50 can serve as collateral for a $100 bank loan.

Traffic card set 34B is also utilized in conjunction with spinning chance indicator 42 for determining the number of points applied to each player driving license for each traffic violation. As shown in FIG. 8, the number of points is determined by the indication of innermost scale 43A. Each player is permitted to compile a maximum of eight penalty points per game without penalty. Once nine traffic points are accumulated a player is eliminated from game competition. In an alternative embodiment a player may be permitted to eliminate points by paying an appropriate fine for each point accumulated over eight to stay in the game. In the preferred embodiment a $25 fine for points in excess of eight is assessed.

Figure 14:
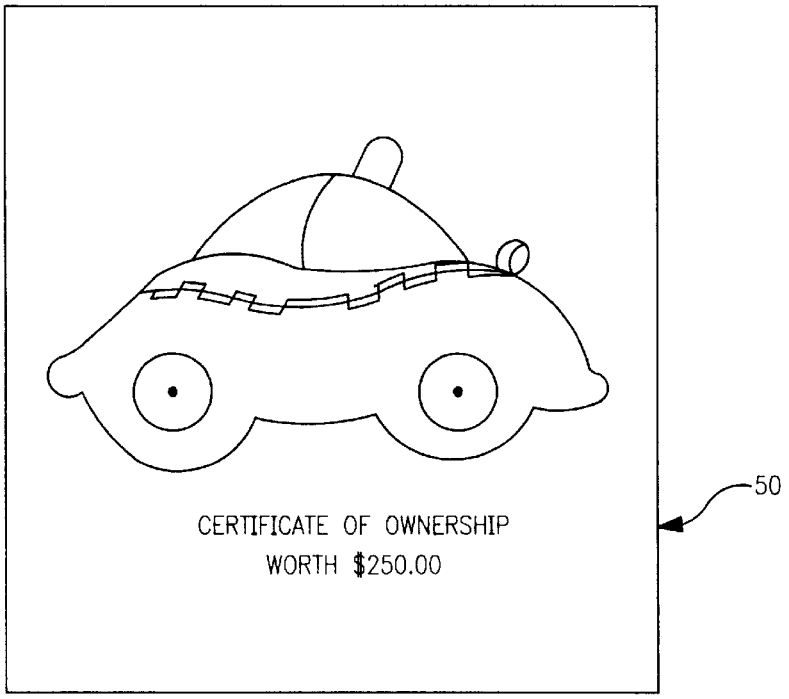
FIG. 14 a view of a secondary surface of the company expansion certificate shown in FIG. 13.
Figure 15:
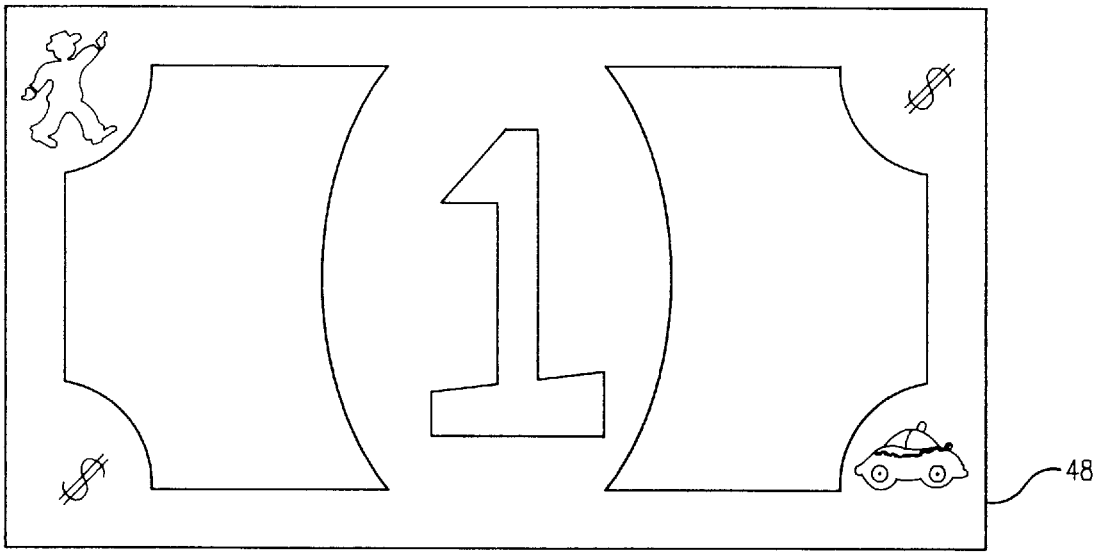
FIG. 15 is a view of a game currency bill.

Players are paid for their services in game currency bills 48, illustrated in FIG. 15. A player may expand his holdings by purchasing additional cab company certificates 50 as illustrated in FIG. 14. Company certificates 50 are purchased for $250 in game currency. For each certificate purchased, the business expenses of a player are increased to account for the added business responsibility. Thus, a player owning two cab company certificates 50 pays twice the fines and penalties mandated by the cards in card sets 34B and 34C. Player's unable to meet payment of a fine, fee, etc., may secure a loan from the bank based on a standard equity value of each company expansion certificate owned. The approximate value is recorded on a surface of the company expansion certificate 50 and is preferably $100.

The winner of the game is the first to purchase, and own free of bank loans, three additional company expansion certificates, or the last player remaining financially viable.

In an alternative embodiment, the "cut-off" route is continuously available. Game players employ a method of play wherein the number of fare playing pieces is limited, further challenging the strategy of game participants as well as increasing the level of competition. For example at the outset of a four player game, the banker selects three consecutive cards from the fare card set 34A. The banker places three fare playing piece 25 on the playing surface 15 at the appropriate location blocks defining a "pick-up" navigational point, as required by the cards drawn from fare direction card set 34A. In this way, the fare playing pieces are limited to a number less than the number of vehicle playing pieces and game participants employ a "cut-off" strategy to beat their opponents to the closest fare playing pieces 25. After the banker assigns the initial group of fare playing pieces 25, game players transporting fare playing pieces 25 to drop-off navigational point select cards from the fare card set 34A to define the location of a new "fares" or fare playing piece 25. The player places a fare playing piece 25 on the playing surface 15 at the appropriate location block defining a new "pick-up" navigational point, as required by the card drawn from fare direction card set 34A. Player's in the area of the "new" fare playing piece 25 may choose to cut-off other players at any time to pick-up the newly designated fare playing piece 25.

The terms and expressions which have been employed are used as terms of description and not of limitation. There is no intention in the use of such terms and expressions of excluding any equivalents of the features shown and described or portions thereof. It is recognized, however, that various modifications are possible within the scope of the invention as claimed.

That which is claimed is:

1. A transportation management board game for use by at least two game players as a contest of business acumen and customer service skills, comprising:

a game board having a playing surface containing a plurality of interconnected location blocks thereon;

a first playing piece representing a transportation customer to be transported between location blocks on the playing surface;

a second playing piece representing a transportation vehicle;

a set of fare cards for designating location blocks as origin and destination points;

a first chance indicator for use by a game player to determine the number of location blocks the game player may traverse per turn to simulate travel between an origin point and a destination point;

a second chance indicator having a plurality of chance movement indicia and chance color indicia;

i. the chance color indicia including colors corresponding to said second playing piece;

ii. the chance movement indicia providing an alternate route for moving the second playing piece to an origin point or a destination point;

a third playing piece for marking a location block as a destination point; and a third random chance indicator for determining the amount of monetary compensation paid to a player for transporting a first playing piece from an origin point to a destination point.

2. The transportation management board game of claim 1 wherein the second playing piece is adapted to hold said first playing piece so as to simulate the transporting of a customer in a vehicle.

3. The transportation management board game of claim 1 wherein the color indicia of the second chance indicator indicate a direct navigational route to an origin point or a destination point when matching the color of the second playing piece.

4. A method of playing a transportation management board game for use by at least two game players as a contest of business acumen and customer service skills, the method comprising the steps of:

determining a fare-pick up location for a first playing piece by drawing a card from a first set of playing cards, said fare pick-up location being one of a plurality of interconnected location blocks on a game board;

placing the first playing piece on the fare pick-up location;

placing a second playing piece on a dispatch area, said dispatch area being one of a plurality of interconnected location blocks on said game board;

moving said second playing piece toward the first playing piece, along the interconnected location blocks;

coupling the first playing piece to the second playing piece upon arrival of said second playing piece at the fare pick-up location occupied by said first playing piece;

determining a fare drop-off location by drawing a card from a first set of playing cards said fare drop-off location being one of a plurality of interconnected location blocks on said game board;

placing a third playing piece on said fare drop-off location;

moving the coupled first and second playing pieces toward the third playing piece, along said interconnected location blocks;

de-coupling the first playing piece from the second playing piece upon arrival of the coupled first and second playing pieces at the fare drop-off location occupied by the third playing piece; and receiving game currency for transporting the first playing piece to the fare drop-off location occupied by the third playing piece.

5. The method of claim 4 wherein the number of interconnected location blocks traversed is dependent on the chance number of a first random chance indicator and a second random chance indicator, the second random chance indicator providing chance direct routes to origin and destination points.

6. The method of claim 4 wherein the amount of game currency received is dependent upon the verbal recitation of a predefined customer service phrase and the chance number of a third random chance indicator.

* * * * *